US005190217A

United States Patent [19]

Black et al.

[11] Patent Number: 5,190,217

[45] Date of Patent: Mar. 2, 1993

[54] APPLICATOR GUN FOR APPLYING SURFACE COATINGS

[75] Inventors: Andrew W. Black, Lake Barrington; Richard M. Kleinke, Crystal Lake, both of Ill.

[73] Assignee: Air Pressure Damp-Proofing Service, Inc., Rolling Meadows, Ill.

[21] Appl. No.: 749,914

[22] Filed: Aug. 26, 1991

[51] Int. Cl.[5] ..... B05B 7/14; B05B 17/00

[52] U.S. Cl. ..... 239/154; 239/424; 239/526; 239/DIG. 8

[58] Field of Search ..... 239/152, 154, 418, 423, 239/424, 526, DIG. 8

[56] References Cited

U.S. PATENT DOCUMENTS

| | | | |
|---|---|---|---|
| 2,565,696 | 8/1951 | Moller et al. . | |
| 2,787,314 | 4/1957 | Anderson . | |
| 3,016,609 | 1/1962 | Huebner . | |
| 3,025,195 | 3/1962 | Kozma . | |
| 3,032,278 | 5/1962 | Thomas et al. . | |
| 3,033,472 | 5/1962 | Shelton . | |
| 3,034,213 | 5/1962 | Milligan . | |
| 3,096,225 | 7/1963 | Carr et al. | 239/526 X |
| 3,107,057 | 10/1963 | Hanusch . | |
| 3,117,376 | 1/1964 | Nawalanic . | |
| 3,130,913 | 4/1964 | Shelton . | |
| 3,185,396 | 5/1965 | Black . | |
| 3,212,717 | 10/1965 | Scheinert . | |
| 3,347,469 | 10/1967 | Ross et al. | 239/526 X |
| 3,399,834 | 9/1968 | Bradley . | |
| 3,414,424 | 12/1968 | Peeps et al. . | |
| 3,504,861 | 4/1970 | Peeps et al. . | |
| 3,542,296 | 11/1970 | Bradley . | |
| 3,622,077 | 11/1971 | Wiegand | 239/424 |
| 3,659,790 | 5/1972 | Gelin . | |
| 3,720,377 | 3/1973 | Hart et al. . | |
| 3,947,962 | 4/1976 | Smith et al. . | |
| 4,089,441 | 5/1978 | Cole et al. | 239/154 X |
| 4,095,748 | 6/1978 | Ohtake et al. . | |
| 4,204,644 | 5/1980 | Kozuka | 239/418 X |
| 4,263,346 | 4/1981 | Sandell | 239/424 X |
| 4,770,117 | 9/1988 | Hetherington et al. . | |
| 4,917,298 | 4/1990 | Henry . | |
| 4,948,048 | 8/1990 | Smith . | |
| 4,967,956 | 11/1990 | Mansfield . | |

*Primary Examiner*—Andres Kashnikow
*Assistant Examiner*—William Grant
*Attorney, Agent, or Firm*—Leydig, Voit & Mayer

[57] ABSTRACT

A hand-held spray gun for directing a mixture of viscous liquid, such as asphalt, and glass particles onto a substrate surface as an integrated coating. The gun includes an elongated barrel, a spray nozzle at a discharge end of the barrel for creating a discharging spray pattern of liquid particles from a pressurized liquid source, a cutter assembly mounted on the barrel intermediate its ends for receiving a continuous glass roving and cutting such roving into particles for direction into the barrel, a fan mounted adjacent an upstream end of the barrel for directing an air flow through the barrel, and a gasoline-powered engine mounted adjacent the fan for simultaneously driving the fan and cutter assembly. A venturi is disposed within the barrel through which the fan-generated air flow is directed and which includes a lateral passageway communicating with the cutter assembly whereby the cut glass particles are drawn into the air flow and forcefully directed through the barrel into intermixing relation with the liquid particles discharging from the spray nozzle.

30 Claims, 3 Drawing Sheets

APPLICATOR GUN FOR APPLYING SURFACE COATINGS

FIELD OF THE INVENTION

The present invention relates generally to applicator guns for applying surface coatings, and more particularly, to applicator guns adapted for applying protective coatings of asphalt infused with glass fibers.

BACKGROUND OF THE INVENTION

Most building structures require the application of protective coatings on exterior areas, such as foundations and roofs, to ensure against the penetration of moisture. It is common practice to apply by means of pressure spray equipment a viscous protective coating, such as asphalt, that is infused with glass fibers. The spray equipment generally is a gun type device having separate sources of asphalt and glass fibers that are simultaneously discharged from a nozzle or barrel end of the device and impinged against the building surface. Spray guns of this type, such as is shown in applicant's prior U.S. Pat. No. 3,185,396, typically require a relatively large source of compressed air such as on the order of 100–125 c.f.m. capacity, for forcefully directing the materials through the gun and onto the building surface. Air compressors of that capacity are relatively expensive and heavy, weighing up to 2000 pounds and more, and usually must be transported to a construction site by truck.

OBJECTS AND SUMMARY OF THE INVENTION

It is an object of the present invention to provide a spray gun that is adapted to spray glass fiber impregnated protective coatings onto surfaces without the necessity for expensive, heavy air compressors.

Another object is to provide a spray gun as characterized above that is of relatively simple construction and which lends itself to economical manufacture and more versatile and reliable usage.

Other objects and advantages of the invention will become apparent upon reading the following detailed description and upon reference to the drawings, in which:

Figure 1:
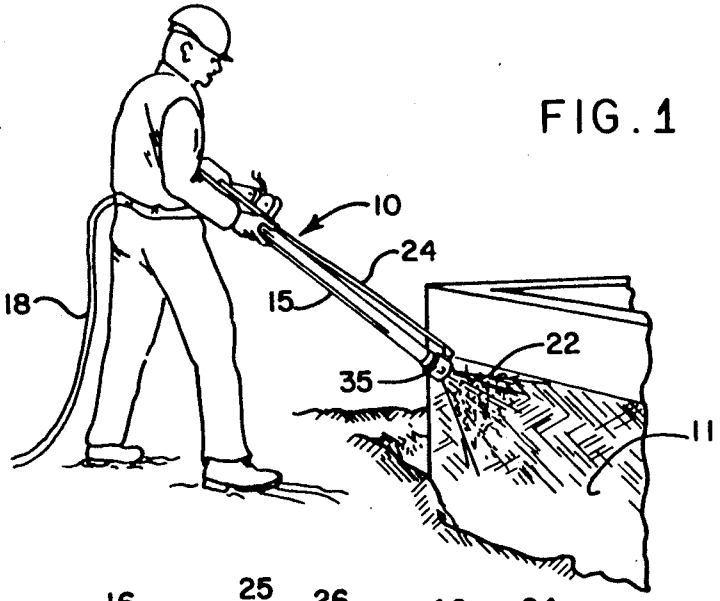
FIG. 1 is a perspective depicting use of a spray gun embodying the present invention.
Figure 2:
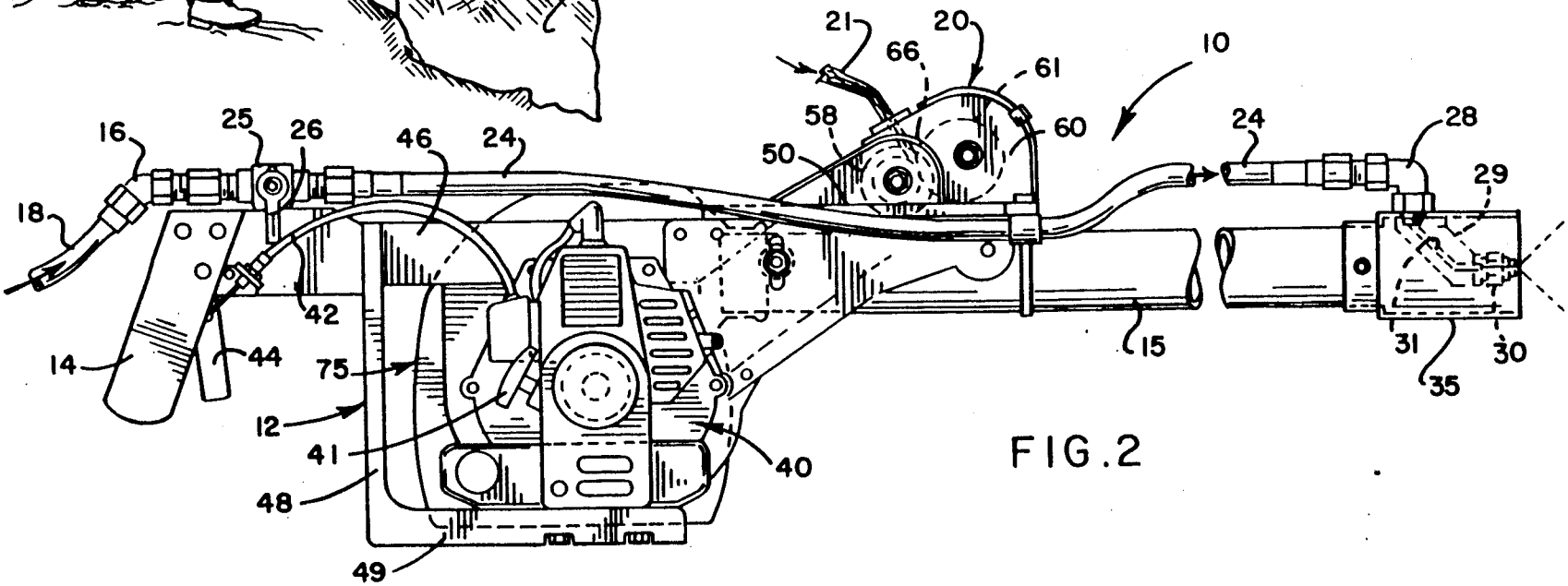
FIG. 2 is an enlarged side elevational view, with a portion broken away, of the illustrated spray gun.
Figure 3:
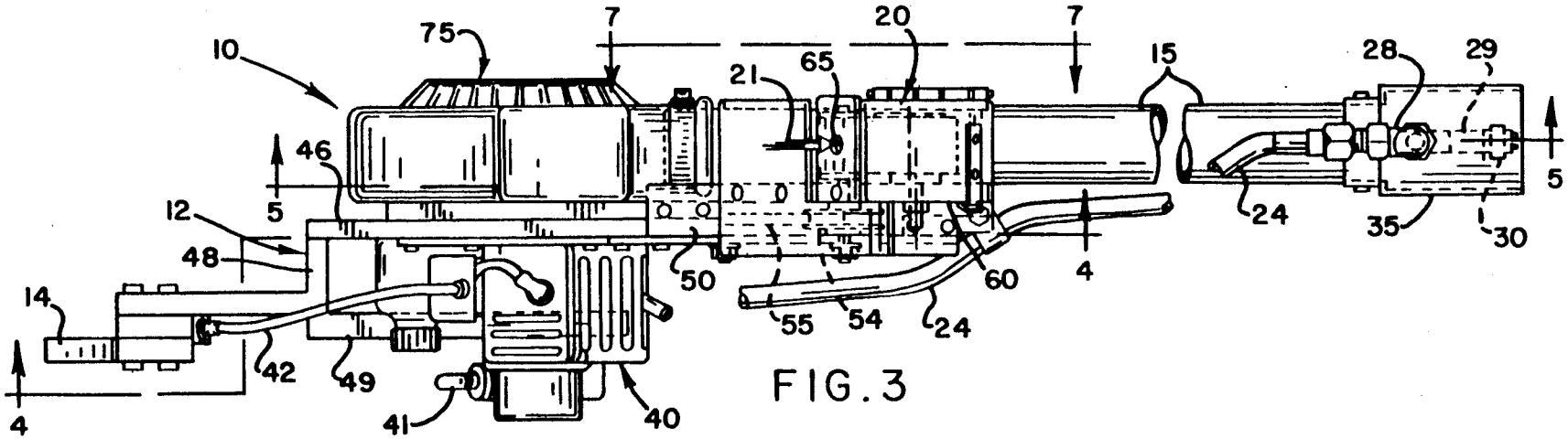
FIG. 3 is a top plan view of the spray gun shown in FIG. 2.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Figure 5:
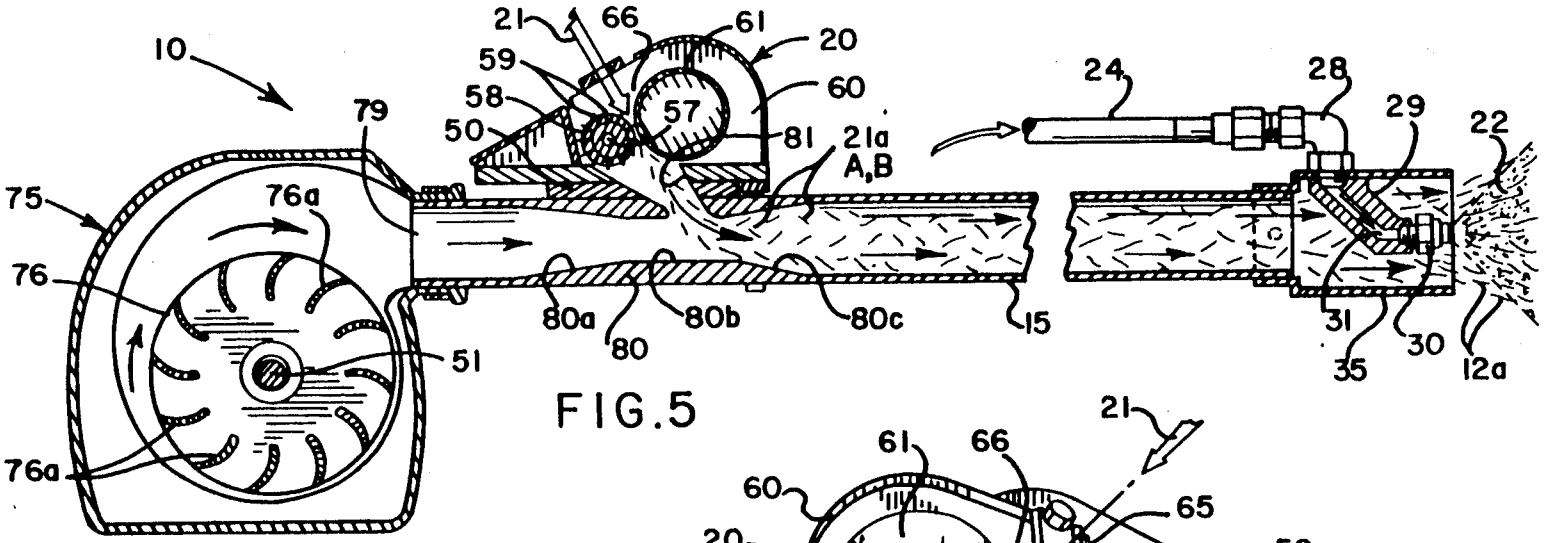
FIG. 5 is a vertical section taken in the plane of line 5—5 in FIG. 3.

Referring now more particularly to the drawings, there is shown an illustrative hand held spray gun 10 embodying the present invention which is adapted for spraying a protective coating, such as a glass fiber infused asphalt, onto building surfaces 11 (FIG. 1). The illustrated spray gun 10 includes a frame 12 having a depending handle section 14 at a rearward end thereof and an elongated horizontal barrel 15 extending forwardly of the frame. The gun 10 includes a liquid inlet 16 in the form of a fitting for coupling to a supply line 18 from a pressurized liquid supply, such as liquid asphalt or like viscous material. The gun 10 further includes a cutter assembly 20 mounted on the frame 12 for receiving a continuous glass roving 21 from a supply roll (not shown) and for cutting the roving into glass fibers **21*a* for infusion into liquid asphalt 22 dispersed from the gun (FIG. 5**).

Figure 6:
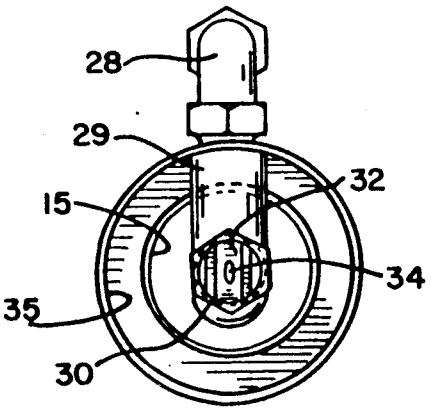
FIG. 6 is an enlarged end view, taken in the plane of line 6—6 in FIG. 4.

The liquid inlet 16 in this instance is connected to a liquid transfer line 24 through a control valve 25 having a handle 26 to permit selective adjustment of the valve 25 for metering the flow of liquid through the transfer line 24, or for shutting off the liquid supply to the gun. The transfer line 24 is trained along the top of the frame 12 and barrel 15 and is connected to a fitting 28 at the forward discharge end of the barrel 15. The fitting 28 in turn is connected to a generally C-shaped nozzle support 29 in the form of a casting that extends into the barrel 15 and carries a spray nozzle 30 on the axis of the barrel 15. The nozzle support 29 is formed with a flow passage 31 communicating between the fitting 28 and spray nozzle 30. The spray nozzle 30 in this case has a V slot 32 (FIG. 6) at the discharge end with a central discharge orifice 34 adapted for emitting a fan-shaped liquid spray pattern in a downstream direction from the barrel 15. In order that the nozzle support 29 does not constrict the barrel and impede air flow therethrough, as will become apparent, the discharge end of the barrel has an enlarged diameter collar section 35 within which the nozzle support 29 is mounted.

In accordance with an important aspect of the invention, the gun includes self-contained motor means for driving the cutter assembly and for simultaneously driving a fan that is operable for imparting an air stream through the barrel and forcefully directing cut glass fibers through the barrel and into the discharging liquid spray and for assisting in the direction, intermixing, and application of the glass fibers and liquid onto the substrate surface as an integrated coating. To this end, the illustrated spray gun 10 has a motor 40, which may be a conventional 21 cc. gasoline-powered engine with a hand-starting pull cord 41 mounted in depending fashion 40 rearwardly of the barrel 15. A throttle 42 for the motor 40 is controlled by a trigger 44 pivotally mounted in forwardly adjacent relation to the handle 14.

Figure 4:
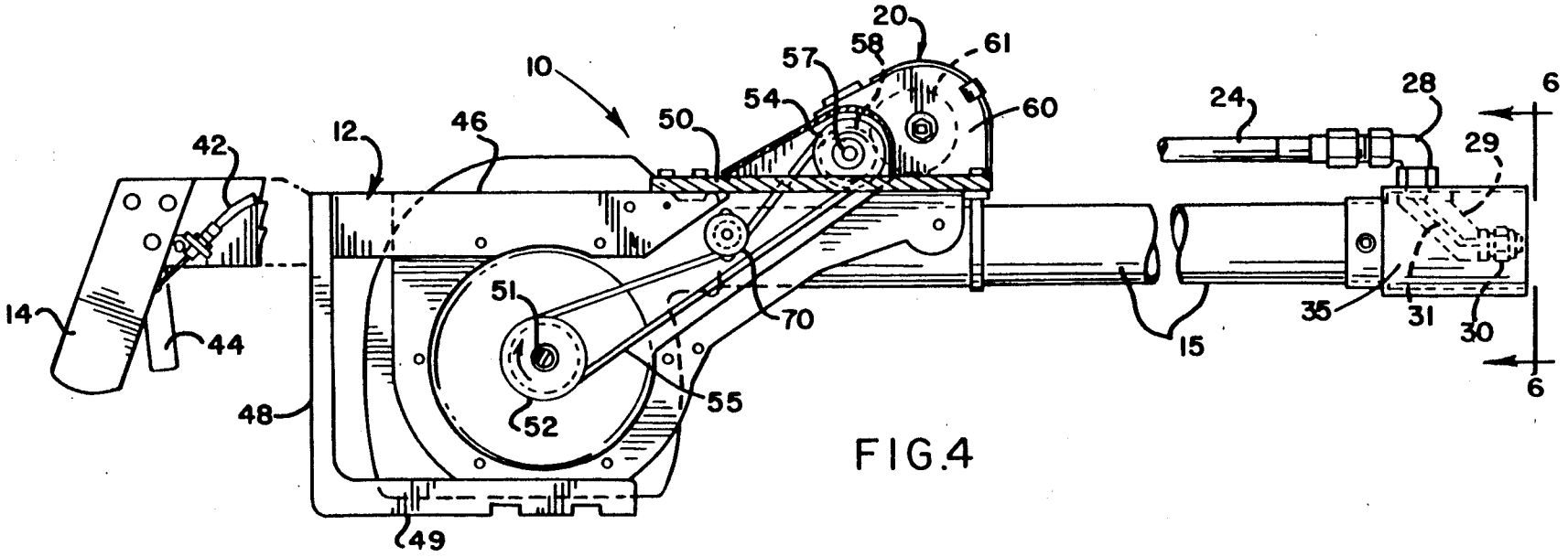
FIG. 4 is a vertical section, taken in the plane of line 4—4 in FIG. 3.

For supporting the motor, the frame 12 includes a forwardly extending top plate 46 and an L-shaped section 48 that defines a forwardly extending lower plate 49 upon which the engine 40 is supported (FIG. 4). The frame 12 further includes an upper horizontal plate 50 extending forwardly of the top plate 46 above and in laterally offset relation to the lower horizontal frame plate 49 and upon which an upper portion of the engine 40 is secured. The engine 40 has a laterally extending drive shaft 51 with a drive pulley 52, in this instance disposed directly below the upper frame plate 46 for driving a drive pulley 54 for the cutter assembly 20 through a belt 55 or like drive train.

Figure 7:
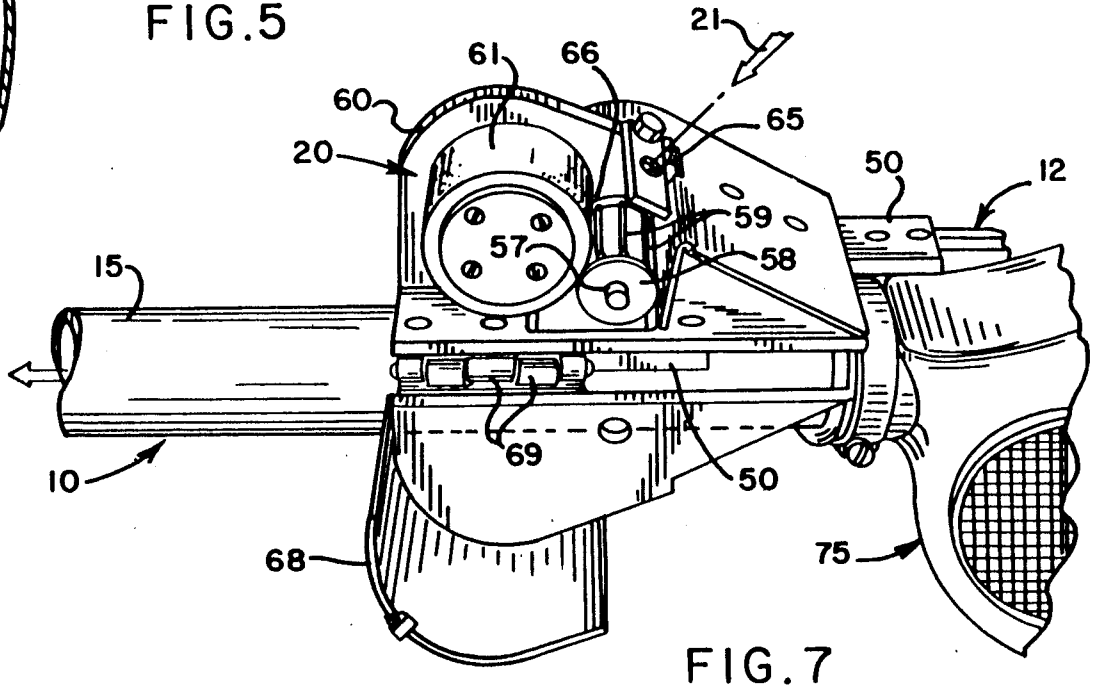
FIG. 7 is an enlarged perspective, as viewed along line 7—7 in FIG. 3.

The cutter assembly 20 includes a cutter roll 58 which is mounted on a drive shaft 57 common to the shaft for the drive puller 54 and has a plurality of circumferentially spaced cutter blades 5 (FIGS. 5 and 7). The drive shaft 57 is rotatably supported by upstanding side walls of a cutter assembly housing 60 mounted on the frame plate 50. The cutter roll 58 is disposed on an outwardly extending end of the shaft 57 in adjacent relation to a free wheeling, back-up roll 61 rotatably carried by the housing 60. The glass roving 21 is drawn from the supply roll and trained through an inlet aperture 65 in the housing 60 as it is directed through a nip 66 defined by the cutter roll 58 and back-up roll 61. The cutter assembly 20 in this case has a cover 68 supported by a hinge 69 for lateral pivotal movement to an open position (FIG. 7) to permit access to and removal and replacement of the cutter and back up rolls 58, 61. It will be seen that upon operation of the motor engine 40, the drive pulley 52 will drive the belt 55, cutter pulley 54 and cutter 58, drawing the glass roving 21 inwardly through the nip 66 between the cutter and back up rolls 58, 61, cutting the roving into predetermined length glass fibers 21*a* as determined by the circumferential spacing between the cutter blades 59. A belt tightener 70 is provided intermediate the pulleys 52, 54 for maintaining proper belt tension.

In carrying out the invention, a fan 75 is driven by the engine shaft 51 for simultaneous operation with the cutter assembly 20 for generating an air flow through the barrel 15 to direct glass fibers 21*a* cut by the cutter assembly 20 forcefully through and out the discharge end of the barrel simultaneously with the liquid spray 22 for intermixing with the liquid spray particles and for assisting in impingement of an integrated mixture of the liquid and glass fibers onto the surface 11 to be coated. The fan 75, which may be of a conventional type used in leaf blowers and the like, includes an impeller 76 mounted on an extension of the motor shaft 51 and having a plurality of circumferentially spaced curved impeller members 76*a*. The impeller 76 is contained within a fan housing 78 having an outlet 79 communicating with the upstream end of the barrel 15. The fan 75 preferably has a capacity for generating an air flow of on the order of 125 c.f.m.

In further carrying out the invention, in order to enhance pick up and direction of the glass fibers 21*a* from the cutter assembly 20, a venturi 80 is mounted within the barrel 15 and has an inlet opening 81 communicating with the underside of the nip 66 between the cutter and back up rolls 58, 61 of the cutter assembly 20 (FIG. 5). The venturi 80 in this instance includes a first converging section 80*a* communicating with the upstream end of the barrel 15 and discharge opening 79 of the fan 75, a reduced diameter section 80*b*, and an outwardly diverging section 80*c* communicating with the downstream end of the barrel 15. The reduced diameter section 80*b* preferably has a diameter of about one-half the diameter of the barrel section 15.

In use of the gun, it can be seen that upon operation of the engine 40, the drive shaft 51 will simultaneously drive the cutter assembly 20 and fan 75, causing glass rovings 21 to be drawn from a supply roll through the cutter assembly 20 and with the cut glass fibers 21*a* being drawn through the venturi 80 by the fan generated air flow through the barrel 15. At the same time, liquid asphalt or the like is directed from a pressurized supply through the inlet 16 of the liquid supply line 18, metered by the control valve 25, and sprayed outwardly in a fan-shaped spray pattern 22 from the spray nozzle 30 of the gun for mixing with the glass fibers 21*a* as they are directed onto the surface 11 to be coated as an integrated mixture.

From the foregoing, it can be seen that the gun of the present invention is of relatively lightweight, portable design and is adapted to effectively spray glass fiber impregnated protective coatings onto surfaces without the necessity for expensive, heavy air compressors. The gun also is of relatively simple construction and lends itself to economical manufacture and more versatile and reliable usage.

What is claimed is:

1. A hand held spray gun for directing a mixture of viscous liquid and glass particles onto a substrate surface comprising an elongated barrel, a spray nozzle supported by said barrel, means for connecting said spray nozzle to a pressurized liquid supply, said spray nozzle being operable for creating a discharging spray pattern of liquid particles from liquid directed to said nozzle from said supply, a glass cutter assembly mounted in fixed relation to said barrel, said cutter assembly including a rotatable cutter blade and means for directing a continuous glass roving to said cutter blade, said cutter blade being rotatable for cutting said continuous glass roving into glass particles for direction into said barrel, a fan mounted in fixed relation to said barrel and being operable for directing an air flow through said barrel in a downstream direction, and a motor mounted in fixed relation to said barrel for simultaneously operating said fan and cutter whereby an air flow directed through said barrel by said fan forcefully directs cut glass fibers through the barrel and into intermixing relation with the liquid particles discharging from said spray nozzle for application onto said substrate surface as an integrated coating.

2. The spray gun of claim 1 in which said motor is a gasoline powered engine.

3. The spray gun of claim 2 in which said fan includes a housing with a discharge opening in communication with an upstream end of said barrel, said fan having an impeller rotatably disposed within said housing, and said engine having a drive shaft upon which said impeller is mounted.

4. The spray gun of claim 3 in which said cutter roll is operatively coupled to said engine drive shaft through a drive train.

5. The spray gun of claim 2 including a handle disposed at a rear end of said barrel, and said engine has a throttle controlled by a trigger pivotably mounted adjacent said handle.

6. The spray gun of claim 2 in which said engine is disposed laterally adjacent a side of said fan at an upstream end of said barrel.

7. The spray gun of claim 6 in which said fan and engine are mounted in depending relation to said barrel.

8. The spray gun of claim 7 including a handle disposed at a rear of said barrel, and said fan and engine are mounted in side-by-side relation in depending fashion from said barrel forwardly of said handle.

9. The spray gun of claim 7 in which said cutter assembly is mounted on a top side of said barrel forwardly of said fan and engine.

10. The spray gun of claim 1 in which said spray nozzle is disposed adjacent a discharge end of said barrel, said cutter assembly being disposed intermediate the ends of said barrel, and said fan and motor are disposed adjacent an upstream end of said barrel.

11. The spray gun of claim 10 including frame means mounted on said barrel for supporting said motor adjacent an upstream end of said barrel.

12. The spray gun of claim 11 in which said frame means includes a horizontal frame plate mounted on said barrel, and a depending frame plate upon which said engine is mounted.

13. The spray gun of claim 12 in which said cutter assembly is mounted on said horizontal frame plate.

14. The spray gun of claim 1 including a venturi disposed within said barrel through which air flow from said fan is directed, said venturi having a converging inlet for receiving air flow from said fan, a constricted section, a diverging discharge section communicating with a downstream end of said barrel, and a lateral passageway communicating between said constricted section and said cutter assembly whereby glass particles cut by said cutter blade are drawn into the fan generated air flow directed through said venturi.

15. The spray gun of claim 14 in which said fan has an outlet in communication with an upstream end of said barrel.

16. The spray gun of claim 15 in which said cutter assembly includes a rotatable cutter roll and a back-up roll which together define a nip through which said continuous roving is directed and from which cut glass particles are emitted.

17. The spray gun of claim 16 in which said lateral passageway communications between said venturi constricted section and said nip.

18. The spray gun of claim 16 in which said cutter assembly has a housing mounted on said barrel within which said cutter roll and back-up roll are rotatably disposed, and said housing having a movable door to permit access to and replacement of said cutter roll and back-up roll.

19. The spray gun of claim 14 in which said constricted section has the diameter of about ½ the diameter of said barrel.

20. The spray gun of claim 1 in which said means for connecting said spray nozzle to said liquid supply includes a supply line disposed along said barrel on an outer side thereof, a C-shaped fitting within said barrel supporting said nozzle substantially coaxially within said barrel at a location adjacent the discharge end of said barrel, and said fitting being formed with an internal flow passageway in communicating between said supply line and nozzle.

21. The spray gun of claim 20 in which said barrel has an enlarged diameter collar portion at the discharge end thereof within which said fitting and spray nozzle are mounted.

22. The spray gun of claim 20 including a selectively operated control valve for controlling the passage of liquid through said supply line.

23. A hand held spray gun for directing a mixture of viscous liquid and glass particles onto a substrate surface comprising an elongated barrel, a spray nozzle supported by said barrel adjacent a discharge end thereof, means for connecting said spray nozzle to a pressurized liquid supply, said spray nozzle being operable for creating a discharging spray pattern of liquid particles from liquid directed to said nozzle from said supply, a glass cutter assembly mounted in fixed relation to said barrel intermediate the ends thereof, said cutter assembly including a rotatable cutter blade and means for directing a continuous glass roving to said cutter blade, said cutter blade being rotatable for cutting said continuous glass roving into glass particles, a fan mounted in fixed relation to said barrel adjacent an upstream end thereof and being operable for directing an air flow through said barrel in a downstream direction, a motor mounted in fixed relation to said barrel adjacent an upstream end thereof for operating said fan, a venturi disposed within said barrel through which the air flow from said fan is directed, said venturi having a converging inlet section communicating with an upstream end of said barrel, a constricted section, a diverging discharge section communicating with a downstream end of said barrel, and a lateral passageway communicating between said constricted section and said cutter assembly whereby glass particles cut by said cutter blade are drawn into the air flow directed through said venturi and are forcefully directed through the barrel and into intermixing relation with liquid particles discharging from said spray nozzle for application onto said substrate surface as an integrated coating.

24. The spray fun of claim 23 in which said constricted section has a diameter of about ½ the diameter of said barrel.

25. The spray gun of claim 23 in which said cutter blade is part of a rotatable cutter roll, said cutter roll and a back-up roll defining a nip through which said continuous roving is directed and from which cut glass particles are emitted, said lateral passageway communicating between said constricted section and said nip.

26. The spray gun of claim 23 in which said motor is a gasoline-powered engine.

27. A hand held spray gun for directing a mixture of viscous liquid and glass particles onto a substrate surface comprising an elongated barrel, a spray nozzle supported by said barrel, means for connecting said spray nozzle to a pressurized liquid supply, said spray nozzle being operable for creating a discharging spray pattern of liquid particles from liquid directed to said nozzle from said supply, a glass cutter assembly mounted in fixed relation to said barrel, said cutter assembly including a rotatable cutter blade and means for directing a continuous glass roving to said cutter blade, said cutter blade being rotatable for cutting said continuous glass roving into glass particles for introduction into said barrel, a motor driven fan mounted in fixed relation to said barrel and being operable for directing an air flow through said barrel in a downstream direction to forcefully direct cut glass fibers introduced into said barrel through said barrel and into intermixing relation with liquid particles discharging from said spray nozzle for application onto said substrate surface as an integrated coating.

28. The spray gun of claim 27 in which said fan includes a housing with a discharge opening in communication with an upstream end of said barrel, said fan having an impeller rotatably disposed within said housing, said motor having a drive shaft upon which said impeller is mounted, and said cutter cutter assembly being operatively coupled to said motor drive shaft through a drive train.

29. The spray gun of claim 27 in which said motor is disposed laterally adjacent a side of said fan in depending relation to an upstream end of said barrel, and said cutter assembly is mounted on a top side of said barrel forwardly of said fan and motor.

30. The spray gun of claim 27 in which said motor is a gasoline powered engine.

* * * * *